US005129557A

United States Patent [19]

Kolton et al.

[11] Patent Number: 5,129,557

[45] Date of Patent: * Jul. 14, 1992

[54] GARMENT HANGER FOR THIN GARMENTS HELD IN CLIPS WITH TWO CHANNELS

[75] Inventors: Chester Kolton, Westfield; Stuart S. Spater, Livingston, both of N.J.

[73] Assignee: A & E Products Group, A Division of Carlisle Plastics, Inc., Woodbridge, N.J.

[ * ] Notice: The portion of the term of this patent subsequent to Mar. 3, 2009 has been disclaimed.

[21] Appl. No.: 628,198

[22] Filed: Dec. 17, 1990

[51] Int. Cl.[5] ..... A47G 25/48; A47G 25/14

[52] U.S. Cl. ..... 223/91; 223/85; 223/96

[58] Field of Search ..... 223/96, 95, 93, 90, 223/85, 88, 92, 91; 211/113; D6/315, 326

[56] References Cited

U.S. PATENT DOCUMENTS

| | | | |
|---|---|---|---|
| 2,828,898 | 4/1958 | Hulett | 223/96 |
| 4,148,421 | 4/1979 | Levitt | 223/91 X |
| 4,223,817 | 9/1980 | Hazenveld | 223/94 |
| 4,295,585 | 10/1981 | Garrison | 223/96 |
| 4,623,079 | 11/1986 | Tendrup et al. | 223/96 X |
| 4,828,155 | 5/1989 | Louw | 223/93 X |
| 4,892,237 | 1/1990 | Duester | 223/88 X |
| 5,002,210 | 3/1991 | Kolton et al. | 223/96 X |

FOREIGN PATENT DOCUMENTS

| | | | |
|---|---|---|---|
| 2069332 | 8/1981 | United Kingdom | 223/85 |

*Primary Examiner*—Werner H. Schroeder
*Assistant Examiner*—Bibhu Mohanty
*Attorney, Agent, or Firm*—Blum Kaplan

[57] ABSTRACT

A garment hanger comprises an integral body of synthetic material having a central portion, a hook portion extending outwardly of said central portion and first and second wing portions at respective opposed side margins of the central portion, the central portion defining, at each side margin thereof, a succession of projections extending outwardly of the side margins, each wing portion defining mutually with the projections a first channel extending into the hanger, the central portion defining a second channel in intersecting relation with the first channel. The second channel is inclined at an acute angle with respect to the first channel and the second channel extends into the central portion interiorly of the side margin thereof.

10 Claims, 2 Drawing Sheets

GARMENT HANGER FOR THIN GARMENTS HELD IN CLIPS WITH TWO CHANNELS

CROSS-REFERENCE TO RELATED APPLICATION

This application is related to application Ser. No. 580,853 of applicants, entitled "Hanger for Lingerie", filed on Sep. 11, 1990 now U.S. Pat. No. 5,092,502.

FIELD OF THE INVENTION

This invention relates generally to lingerie hangers and pertains more particularly to improved hangers for panties.

BACKGROUND OF THE INVENTION

A wide variety of panty hangers are presently known to comprise an integral plastic frame having a hook portion and a body portion, the latter having generally horizontally extending wing portions. Each wing portion has a gripping finger structure at its free end. Examples of such hangers are seen in U.S. Pat. No(s). 3,738,549 and 4,623,079.

From applicants' perspective, known panty hangers exhibit less than desired gripping finger structure. Thus, the hanging function is in the vertical plane of the hangers and depends on frictional engagement of the panty waistband and the finger structure, arising from the elasticity of the waistband and the strength of the gripping structure. Additional retention function would evidently be desirable.

The invention of the referenced and copending application provides a hanger comprised of an integral body of synthetic material having a central portion, a hook portion extending outwardly of the central portion and first and second wing portions at respective opposed side margins of the central portion, the central portion defining, at each side margin thereof, a succession of diversely-sized projections extending outwardly of the side margins, the projections being of generally arcuate configuration and each of successively lesser size progressively distal of the hook portion. Each wing portion comprises a member cantilever-supported by the central portion, each such cantilever-supported member defining mutually with the projections spacings of successively lesser measure progressively distal of the hook portion.

Preferably, the succession of diversely-sized projections includes a first and a second projection, the first projection being of generally semi-circular configuration outwardly of the side margins, the second projection being generally of configuration comprising a sector of a circle substantially less than a semi-circle.

While the hanger of the referenced application is found adequate, applicants have pursued improvement thereto, as is found in structures discussed herein.

SUMMARY OF THE INVENTION

The present invention has as its primary object the provision of further improved panty hangers.

In attaining the foregoing and other objects, the invention herein provides a garment hanger comprised of an integral body of synthetic material having a central portion, a hook portion extending outwardly of said central portion and first and second wing portions at respective opposed side margins of the central portion, the central portion defining, at each side margin thereof, a succession of projections extending outwardly of the side margins, each wing portion defining mutually with the projections a first channel extending into the hanger, the central portion defining a second channel in intersecting relation with the first channel.

In the particularly preferred embodiments, the second channel is inclined at an acute angle with respect to the first channel and the second channel extends into the central portion interiorly of the side margin thereof.

The foregoing and other features of the invention will be further understood from the following detailed description of a preferred embodiment thereof and from the drawings wherein like reference numerals identify like components and parts throughout.

DESCRIPTION OF THE PREFERRED EMBODIMENTS AND PRACTICES

Figure 1:
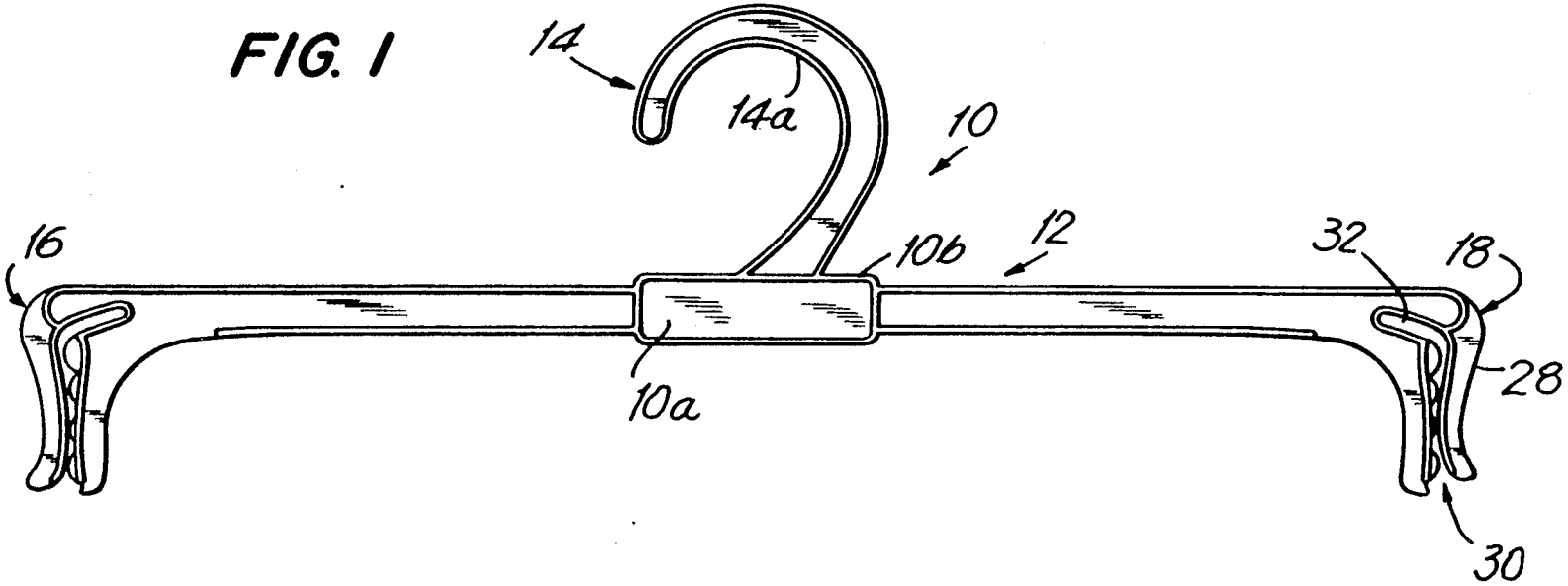
FIG. 1 is a front elevation of a first embodiment of a hanger in accordance with the invention.
Figure 2:
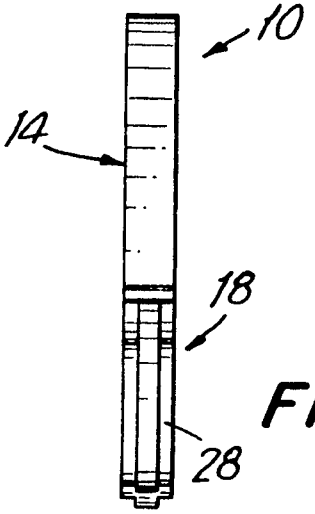
FIG. 2 is a right side elevation of the FIG. 1 hanger.
Figure 3:
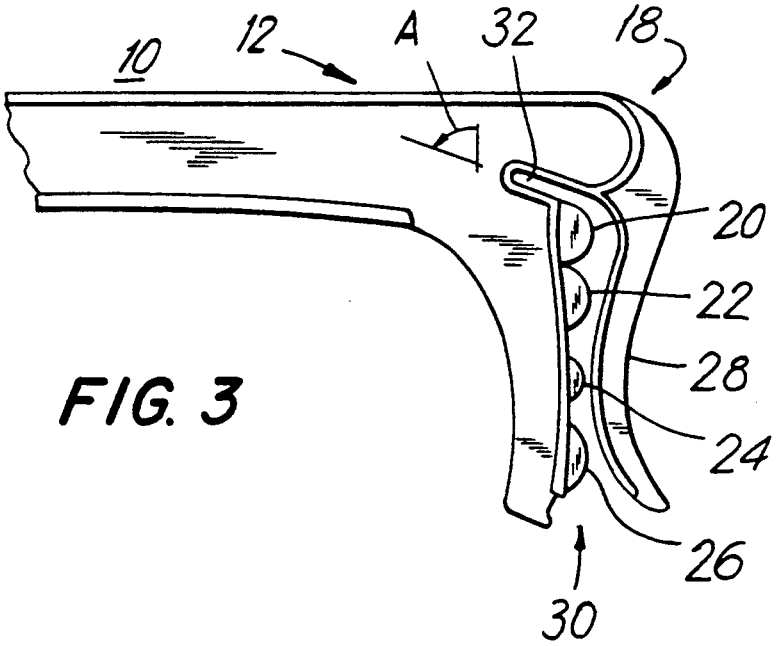
FIG. 3 is an enlarged view of the rightward end portion of the FIG. 1 hanger.

Referring to FIGS. 1–3, accessory hanger 10 is comprised of an integral body of synthetic material having a central portion 12, a hook portion 14 extending outwardly of central portion 12 and first and second wing portions 16 and 18 at respective opposed side margins of central portion 12. The central portion defines, at each side margin thereof, a succession of diversely-sized projections extending outwardly of the side margins. Considering the rightward side margin of central portion 12 in FIG. 3, projections 20, 22, 24 and 26 are of generally arcuate configuration outwardly of the side margin. Projections 20, 22 and 24 will be seen to be of successively lesser size progressively distal of hook portion 14. Projection 26 is somewhat larger in size than its predecessor, projection 24.

Wing portions 16 and 18 each comprise a member cantilever-supported by the central portion. Considering wing portion 18, cantilever-supported member 28 defines mutually with projections 20 through 26 spacings of successively lesser measure progressively distal of hook portion 14.

Figure 4:
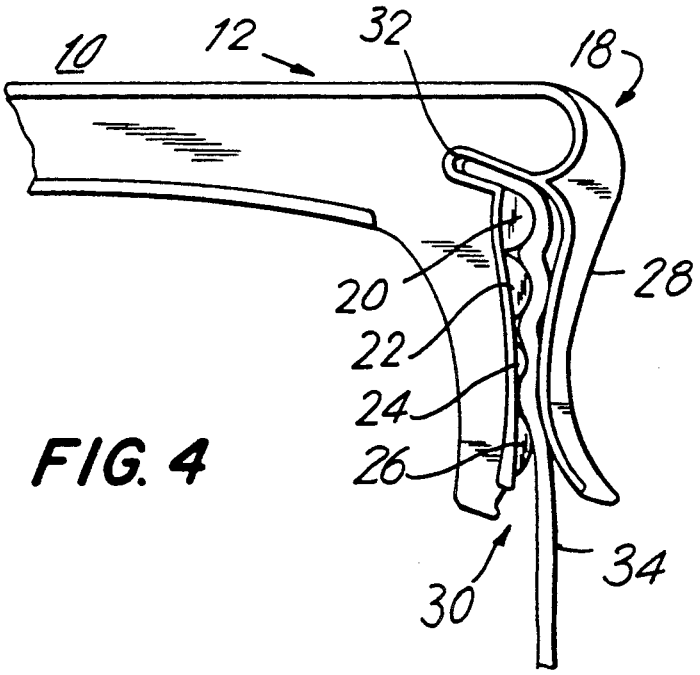
FIG. 4 is a repeat showing of FIG. 3 with a panty shown as hung from the FIG. 1 hanger.

In the enlarged partial view of FIG. 4, panty 30 is shown supported by wing portion 18. The embodiment of FIG. 6 of the referenced '853 patent application includes the hanger structure thus far discussed herein and, with such hanger, the panty is found to bunch up in the upper area of the wing portion, based on the interaction of cantilever-supported member and the projections as the panty is inserted into the wing portion. The projection which is uppermost thereupon acts as an impediment to movement of the bunched up panty part downwardly and outwardly of the wing portion. Further retention is derived by the pinching action of the cantilever-supported member and the projections.

In accordance with the subject invention, seen particularly in FIG. 3, each wing portion has a first channel 30 extending into the hanger, defined as in the case of the '853 patent application by the cantilever-supported member and the projections, and otherwise further defines a second channel 32 in intersecting relation with the first channel. Second channel 32 is inclined at an acute angle A with respect to first channel 30 and the second channel extends into the central portion interiorly of the side margin thereof.

In contrast to simply a bunching up action, the subject invention supplements the same with the providing of egress for the bunched up panty portion into the hanger central portion, as is seen in FIG. 4 for hung panty 34.

As illustrated in FIG. 1, hanger 10 is desirably reinforced, as by having thickened margins, as is indicated at 14*a* for hook portion 14. A logo/size display area is provided at 10*a*.

In the particularly preferred and depicted embodiment, four projections are employed on each side of the hanger. However, the subject invention may be practiced with other numbers of projections, as in the other embodiments depicted in the '853 patent application, to which incorporating reference is hereby made.

In the described embodiment, the second channel is located at an end of the first channel opposite the open end thereof, the second channel being inclined at an acute angle with respect to the first channel and the second channel extends into the central portion interiorly of the side margin thereof. Other geometries will of course be seen to apply in implementing the invention.

In further summary of the preferred embodiment, the projections are diversely-sized and of generally arcuate configuration, a group of the projections, 20, 22 and 24, being of successively lesser size progressively distal of the hook portion, each cantilever-supported member defining mutually with said projections spacings of successively lesser measure progressively distal of the hook portion. The projections further include a projection 26 successive to the group of projections and of greater size than the adjacent projection in the group of projections.

Various changes to structure and modifications in practice may be introduced in the foregoing embodiment and practice without departing from the invention. Thus, the particularly discussed and depicted embodiment is intended in an illustrative and not in a limiting sense. The true spirit and scope of the invention is set forth in the following claims.

We claim:

1. A garment hanger comprised of an integral body of synthetic material having a central portion, a hook portion extending outwardly of said central portion and first and second wing portions at respective opposed side margins of said central portion, said central portion defining, at each said side margin thereof, a succession of projections extending outwardly of said side margins, each said wing portion comprising a member cantilever-supported by said central portion, each such cantilever-supported member defining mutually with said projections a first channel extending into said hanger and having an open end for garment receipt, said central portion defining a second channel in communication with said first channel at a location distal from said open end of said first channel and extending at an acute angle with respect to said first channel.

2. The invention claimed in claim 1 wherein said second channel is located at an end of said first channel opposite said open end thereof.

3. The invention claimed in claim 2 wherein said second channel extends into said central portion interiorly of said side margin thereof.

4. The invention claimed in claim 1 wherein said projections are diversely-sized and of generally arcuate configuration, a group of said projections being of successively lesser size progressively distal of said hook portion, each said cantilever-supported member defining mutually with said projections spacings of successively lesser measure progressively distal of said hook portion.

5. The invention claimed in claim 4 wherein said projections further include a projection successive to said group of projections and of greater size than the adjacent projection in said group of projections.

6. A garment hanger comprised of an integral body of synthetic material having a central portion, a hook portion extending outwardly of said central portion and first and second wing portions at respective opposed side margins of said central portion, said central portion defining, at each said side margin thereof, a succession of projections extending outwardly of said side margins, each said wing portion defining mutually with said projections a first channel extending into said hanger, said central portion defining a second channel in intersecting relation with said first channel and extending at an acute angle with respect to said channel.

7. The invention claimed in claim 6 wherein said second channel is located at an end of said first channel opposite said open end thereof.

8. The invention claimed in claim 7 wherein said second channel extends into said central portion interiorly of said side margin thereof.

9. The invention claimed in claim 7 wherein said projections are diversely-sized and of generally arcuate configuration, a group of said projections being of successively lesser size progressively distal of said hook portion, each said cantilever-supported member defining mutually with said projections spacings of successively lesser measure progressively distal of said hook portion.

10. The invention claimed in claim 9 wherein said projections further include a projection successive to said group of projections and of greater size than the adjacent projection in said group of projections.

* * * * *